US011337517B1

(12) United States Patent
Nifong

(10) Patent No.: US 11,337,517 B1
(45) Date of Patent: May 24, 2022

(54) BOOK STAND WITH IMPROVED READABILITY FEATURES AND PAGE TURNING CAPABILITIES

(71) Applicant: Lyla Kate Nifong, Lexington, NC (US)

(72) Inventor: Lyla Kate Nifong, Lexington, NC (US)

( * ) Notice: Subject to any disclaimer, the term of this patent is extended or adjusted under 35 U.S.C. 154(b) by 0 days.

(21) Appl. No.: 17/666,005

(22) Filed: Feb. 7, 2022

(51) Int. Cl.
*A47B 23/06* (2006.01)
*A47B 23/04* (2006.01)
*B42D 9/04* (2006.01)

(52) U.S. Cl.
CPC ..... *A47B 23/06* (2013.01); *A47B 23/044* (2013.01); *B42D 9/04* (2013.01)

(58) Field of Classification Search
CPC ..... A47B 23/06; A47B 23/042; A47B 23/043; A47B 23/044; B42D 9/04; B42D 9/06
See application file for complete search history.

(56) References Cited

U.S. PATENT DOCUMENTS 4,685,374 A * 8/1987 Goldner ..... B42D 9/06 84/505
5,149,046 A * 9/1992 Kerley ..... B42D 9/04 248/463
5,433,415 A * 7/1995 Samson ..... A47B 23/06 248/448
8,646,193 B1 * 2/2014 Li ..... B42D 9/04 84/486
10,097,723 B2 * 10/2018 Hasegawa ..... B42D 9/06
2003/0003429 A1 * 1/2003 Jung ..... B42D 9/06 434/169
2004/0107612 A1 * 6/2004 Jung ..... B42D 9/04 40/343
2004/0187669 A1 * 9/2004 Steffens ..... B42D 9/04 84/486
2005/0145097 A1 * 7/2005 Wolberg ..... B42D 9/04 84/486
2005/0230592 A1 * 10/2005 Tillinghast ..... B42D 9/06 248/441.1
2007/0285742 A1 * 12/2007 Wolberg ..... B42D 9/04 358/498
2012/0219012 A1 * 8/2012 Beaudoin ..... H04N 21/6405 370/466
2017/0072731 A1 * 3/2017 Yamada ..... B42D 9/04
2017/0277019 A1 * 9/2017 Tachibana ..... G03B 17/561
2018/0070720 A1 * 3/2018 Ko ..... A47B 23/04
2019/0092076 A1 * 3/2019 Hasegawa ..... H04N 1/00559
2019/0365092 A1 * 12/2019 Zhang ..... A47B 23/043
2021/0252898 A1 * 8/2021 Duan ..... B42D 9/04

* cited by examiner

*Primary Examiner* — Daniel J Rohrhoff
(74) *Attorney, Agent, or Firm* — NK Patent Law

(57) ABSTRACT

A device for turning pages in a book includes a main frame and a bottom support configured for engaging a bottom lip of a book's binder. The bottom support is hingedly connected to the main frame. A top support is configured for engaging a top lip of a book's binder. The top support is hingedly connected to the main frame. A kick stand extends from a back surface of the main frame for providing support to the device. A light is carried by the bottom support or top support for providing illumination of the book. A pair of blades extend from one of the bottom support or the top support for imparting movement of pages of the book to a subsequent page. An actuator imparts movement to the blades and the actuator is responsive to detecting a user's audible instruction to change a page.

10 Claims, 3 Drawing Sheets

BOOK STAND WITH IMPROVED READABILITY FEATURES AND PAGE TURNING CAPABILITIES

BACKGROUND

Field of the Invention

This disclosure is directed towards a device for turning pages in a book. More particularly, the device allows hands-free reading of a book where the device turns the pages in response to input from the user. Other advantageous features to support readability are also provided.

Description of Related Art

Conventional reading of books required the reader to have both hands on the book and to turn each page to the subsequent page upon completion of reading of a given page. This required muscular control and would oftentimes result in fatigue, muscle cramps, and other associated ailments. Furthermore, it may make the book reading process less enjoyable for the reader.

The reading process was further encumbered by lack of lighting upon the book, particularly if a user was in bed and the book was oriented in such a manner where it was not receiving significant amounts of lighting from overhead lights. This strained the reader's eyes and also added to a less enjoyable reading process.

Some page turner devices have been developed, however, these devices continue to suffer from the same shortcomings. For example, U.S. Pat. No. 9,056,516 to Hasegawa, teaches a cumbersome device that is expensive to produce, and requires a flat working surface for the book such as a user sitting at a desk. That does not help a user positioned in other reading environments.

Other devices are not adaptable and adjustable to books of various sizes. Since books come in paperback and hardback form, and may be of smaller stature or larger books like a college textbook, adaptability of the device to fit various sizes of books would be advantageous.

Finally, the page turner device needs to be responsive to a user's request to turn the page. In the event of a page turner that is controlled by pressing on an actuator, such as a step controlled actuator, this limits the environments upon which the page turner can be employed. Additionally, it requires additional movement input to press on the actuator, which is adverse to the stated desire of having a page turner with less user mechanical input.

Accordingly, a device is needed to address these shortcomings.

BRIEF SUMMARY

According to one embodiment of the present invention, a device for turning pages in a book includes a main frame and a bottom support configured for engaging a bottom lip of a book's binder. The bottom support is hingedly connected to the main frame. A top support is configured for engaging a top lip of a book's binder. The top support is hingedly connected to the main frame. A kick stand extends from a back surface of the main frame for providing support to the device. A light is carried by the bottom support or top support for providing illumination of the book. A biasing member extends from the main frame for biasing the book into engagement with the bottom support. A pair of blades extend from one of the bottom support or the top support for imparting movement of pages of the book to a subsequent page. An actuator imparts movement to the blades and the actuator is responsive to detecting a user's audible instruction to change a page.

According to one or more embodiments, the bottom support is adjustable in length.

According to one or more embodiments, the top support is adjustable in length.

According to one or more embodiments, the device includes a power button for changing an operational status of the device.

According to one or more embodiments, the device includes an audio receiver for receiving the user's audible instructions.

According to one or more embodiments, the kick stand is adjustable in length.

According to one or more embodiments, the actuator is responsive to pressing of a button.

According to one or more embodiments, the device has an in-use orientation where the bottom support and top support are positioned perpendicularly to the main frame and a collapsed orientation where the top and bottom supports are rotated into a generally flat orientation.

According to one or more embodiments, the main frame is adjustable in length.

According to one or more embodiments, the biasing member is a helical spring.

DETAILED DESCRIPTION

Figure 1:
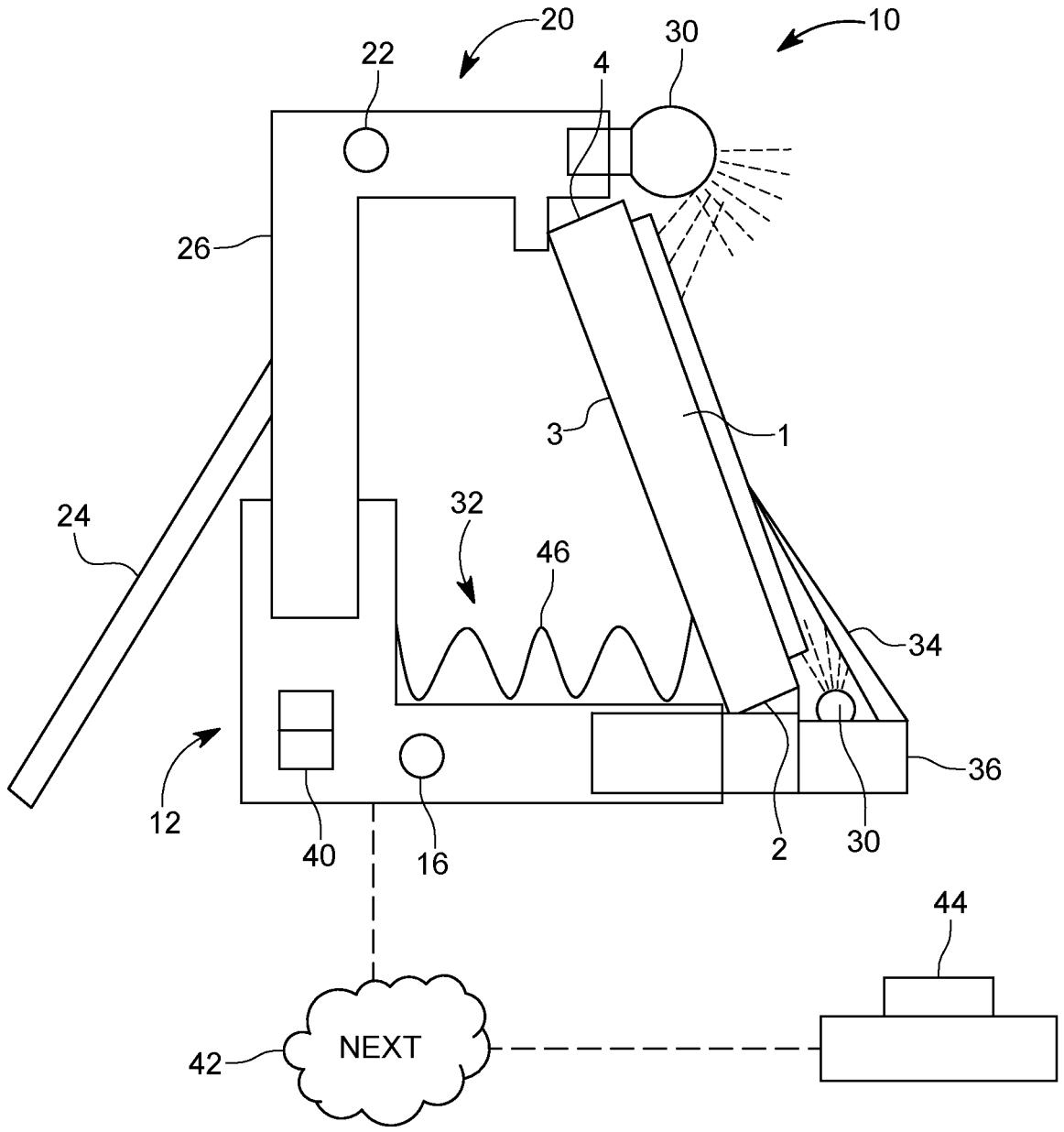
FIG. 1 is a side view of a page turning device according to one or more embodiments disclosed herein.
Figure 2:
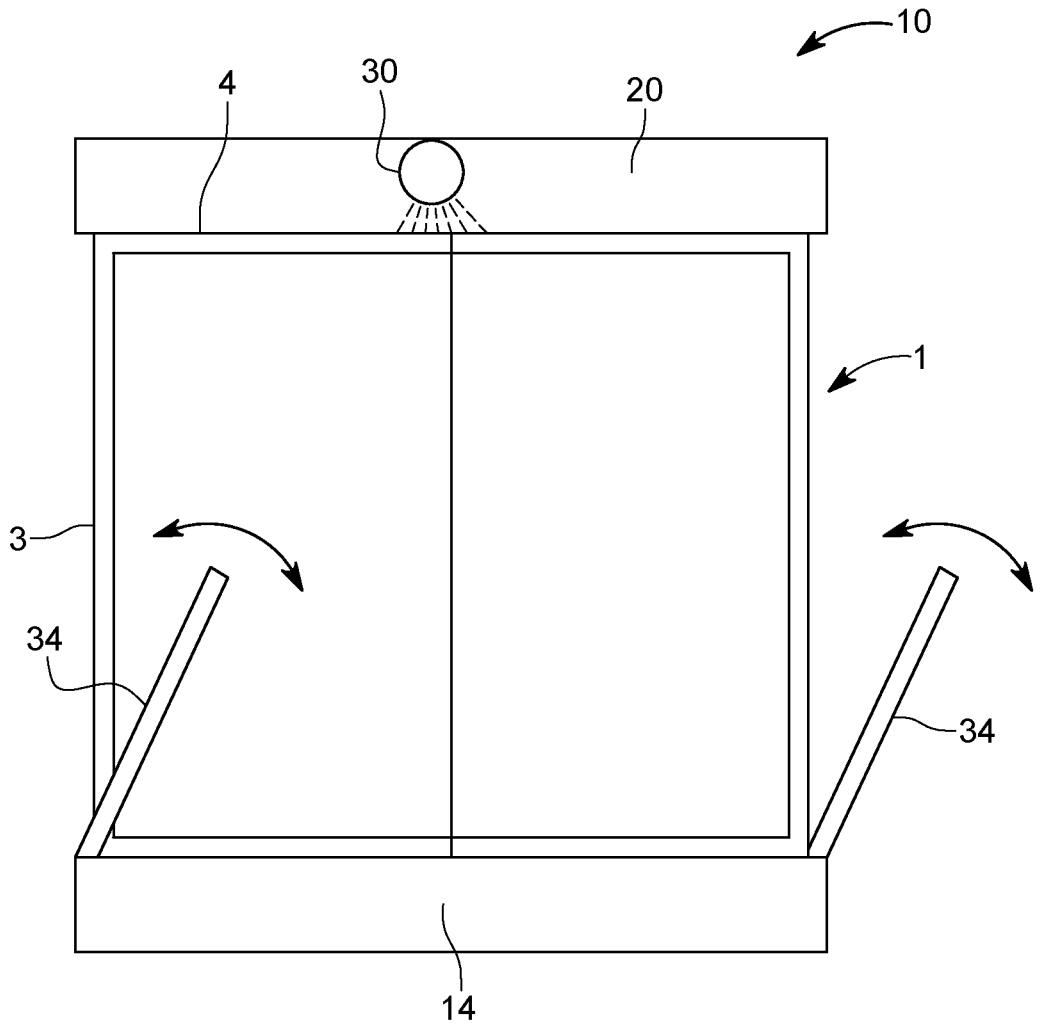
FIG. 2 is a front view of the page turning device according to one or more embodiments disclosed herein.

With reference now to FIG. 1, a device for turning pages in a book is generally designated 10. The device 10 includes a main frame 12 and a bottom support 14 configured for engaging a bottom lip 2 of a book's binder 3. The bottom support 14 is hingedly connected to the main frame 12 by a hinged joint 16. A top support 20 is configured for engaging a top lip 4 of the book's binder 3. The top support 20 is hingedly connected through a hinge or pivot 22 to the main frame 12. A kick stand 24 extends from a back surface of the main frame 12 for providing support to the device 10. A light 30 is carried by the device 10, and may be positioned on the bottom support 14 or top support 20 for providing illumination of the book 1. A biasing member 32 extends from the main frame 12 for biasing the book 1 into engagement with the bottom support 14. The biasing member 32 may be a helical spring as illustrated.

A pair of blades 34 extend from one of the bottom support 14 or the top support 20 for imparting movement of pages 5 of the book 1 to a subsequent page. An actuator 36 provides movement to the blades 34, which move in a side to side, pivoting arrangement similar to windshield wiper blades. The blades 34 have a tacky or adhesive surface on an end thereof that momentarily engage the pages 5 of the book and then disengage a respective page 5 once the page has turned enough that there is not sufficient surface area contact between the end of the blade and the page 5. Thus the right most blade flips the page up and over the book's centerline, and the left most blade tamps down on the flipped page. The blades could be embodied as a single blade. Additionally, the blades may be reversible in direction in response to a user command if, for example, too many pages were inadvertently flipped.

The actuator 36 is responsive to detecting a user's audible instruction to change a page. For example, the actuator is coupled with an audio receiver 42. The audio receiver 42 is in communication with a processor module that may include a processor, random access memory and permanent storage memory, and may be coupled by direct wired communication or near range communication. The audio receiver 42 is configured to receive commands from the user, which the user can record for receipt by the audio receiver. For example, the user could set a programming step where the audio receiver learns the user's voice. The user could then direct the audio receiver 42 to listen for "next page" if that is the desired command by the user. Or the audio receiver 42 could be pre-programmed for "next page" or a similar. Alternatively, the actuator 36 can be responsive to pressing of a button 44 on a provided hardware device. For example, a button 44 for being pressed by a user's foot can be employed, or another button on the device 10 itself.

The device 10 has additional advantageous aspects beyond the page turning features. Namely, the device 10 is adjustable in length to accommodate different size books, and the device is collapsible to a stowed position or orientation, as will be described further herein. For example, the bottom support 14 may be adjustable in length. This may be accomplished by telescoping movement of respective components of the bottom support 14 where one component is able to slide within another. In this manner, the bottom support 14 is adaptable to various size books. Similarly, the top support 20 may also be adjustable in the same manner. Similarly, the kick stand 24 is also adjustable in length.

A power button 40 may also be provided. The power button 40 may selectively enable operation of the light 30, operation of the actuator 36, and operation of the audio receiver 42. Alternatively, separate buttons or input modules may be provided for each of these features.

Figure 3:
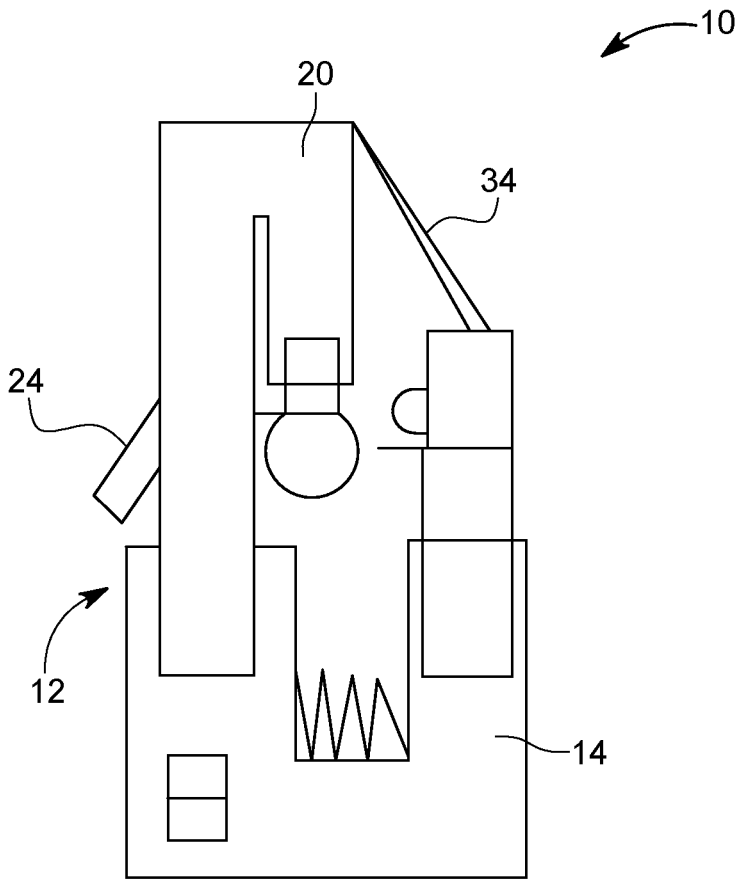
FIG. 3 is a side view of the page turning device in a collapsed orientation according to one or more embodiments disclosed herein.

As illustrated in FIG. 3, the device 10 is also collapsible and has an in-use orientation where the bottom support 14 and top support 20 are positioned perpendicularly to the main frame 12 and a collapsed orientation (illustrated in FIG. 3) where the bottom support 14 and top support 20 are rotated towards the main frame 12 into a generally flat orientation for stowage.

The device 10 is thus adjustable, portable, hands free, and provides illumination advantages not known in the prior art.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device for turning pages in a book, comprising:

a main frame;

a bottom support configured for engaging a bottom lip of a book's binder, wherein the bottom support is hingedly connected to the main frame;

a top support configured for engaging a top lip of a book's binder, wherein the top support is hingedly connected to the main frame;

a kick stand extending from a back surface of the main frame for providing support to the device;

a light carried by the bottom support or top support for providing illumination of the book;

a biasing member extending from the main frame for biasing the book into engagement with the bottom support;

a pair of blades extend from one of the bottom support or the top support for imparting movement of pages of the book to a subsequent page; and an actuator that imparts movement to the blades, wherein the actuator is responsive to detecting a user's audible instruction to change a page.

2. The device according to claim 1, wherein the bottom support is adjustable in length.

3. The device according to claim 1, wherein the top support is adjustable in length.

4. The device according to claim 1, further including a power button for changing an operational status of the device.

5. The device according to claim 1, further including an audio receiver for receiving the user's audible instructions.

6. The device according to claim 1, wherein the kick stand is adjustable in length.

7. The device according to claim 1, wherein the actuator is responsive to pressing of a button.

8. The device according to claim 1, wherein the device has an in-use orientation where the bottom support and top support are positioned perpendicularly to the main frame and a collapsed orientation where the top and bottom supports are rotated into a generally flat orientation.

9. The device according to claim 1, wherein the main frame is adjustable in length.

10. The device according to claim 1, wherein the biasing member is a helical spring.

* * * * *